US007331320B2

(12) United States Patent
Asada

(10) Patent No.: US 7,331,320 B2
(45) Date of Patent: Feb. 19, 2008

(54) ENGINE STARTING APPARATUS AND METHOD

(75) Inventor: Toshiaki Asada, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/577,649

(22) PCT Filed: Nov. 5, 2004

(86) PCT No.: PCT/JP2004/016810

§ 371 (c)(1),
(2), (4) Date: May 1, 2006

(87) PCT Pub. No.: WO2005/045240

PCT Pub. Date: May 19, 2005

(65) Prior Publication Data

US 2007/0068476 A1 Mar. 29, 2007

(30) Foreign Application Priority Data

Nov. 7, 2003 (JP) ..... 2003-377923

(51) Int. Cl.
*F02N 3/00* (2006.01)
*F02N 11/00* (2006.01)

(52) U.S. Cl. ..... 123/179.24

(58) Field of Classification Search ..... 123/179.3, 123/179.25, 179.26, 179.4
See application file for complete search history.

(56) References Cited

U.S. PATENT DOCUMENTS 1,979,302 A 11/1934 Whitney
3,830,110 A * 8/1974 Suzuki ..... 74/6
4,930,467 A * 6/1990 Masuda et al. ..... 123/179.24
5,079,945 A 1/1992 Hansen et al.
5,884,599 A * 3/1999 Shiozaki et al. ..... 123/192.2
6,305,337 B1 * 10/2001 Sumi et al. ..... 123/179.25
6,354,257 B1 3/2002 Marshall et al.
6,637,398 B2 * 10/2003 Suzuki et al. ..... 123/195 R
6,786,212 B1 * 9/2004 Choi ..... 123/631
6,851,404 B2 * 2/2005 Kojima ..... 123/179.1
6,904,889 B2 * 6/2005 Matsuda et al. ..... 123/198 A
6,987,373 B2 * 1/2006 Kagami et al. ..... 318/471
7,147,077 B2 * 12/2006 Morii et al. ..... 180/291
7,174,979 B2 * 2/2007 Ohta et al. ..... 180/65.2
7,219,646 B2 * 5/2007 Ueshima ..... 123/197.1
2003/0140881 A1 * 7/2003 Makajima et al. ..... 123/179.3
2004/0000281 A1 * 1/2004 Wakitani et al. ..... 123/179.3
2004/0060530 A1 * 4/2004 Mitani et al. ..... 123/179.3
2004/0139938 A1 * 7/2004 Tanei et al. ..... 123/179.3

(Continued)

FOREIGN PATENT DOCUMENTS

DE 621 485 10/1935

(Continued)

*Primary Examiner*—Stephen K. Cronin
*Assistant Examiner*—Arnold Castro
(74) *Attorney, Agent, or Firm*—Oliff & Berridge, PLC

(57) ABSTRACT

An engine starting apparatus has a reverse-rotation detection sensor for detecting the reverse rotation of an engine. A control apparatus for controlling the engine starting apparatus performs such control that a starter motor is not rotated while the reverse rotation of the engine is detected by the reverse-rotation detection sensor, even if receiving a predetermined engine start command.

9 Claims, 2 Drawing Sheets

U.S. PATENT DOCUMENTS

2004/0251072 A1* 12/2004 Morii et al. ..... 180/297
2007/0084429 A1* 4/2007 Taki et al. ..... 123/179.4

FOREIGN PATENT DOCUMENTS

EP 1 070 964 A2 1/2001
JP A 07-158543 6/1995
JP A-07-158543 6/1995
JP A-2002-130095 5/2002
JP A-2003-083216 3/2003
JP A 2003-083216 3/2003

* cited by examiner

ENGINE STARTING APPARATUS AND METHOD

TECHNICAL FIELD

The present invention relates to an engine starting apparatus which includes a starter motor and a power transmission mechanism to transmit the power from the starter motor, used in starting an engine of a vehicle, as well as an engine starting method.

BACKGROUND ART

In this type of engine starting apparatus, a crankshaft of the engine and the starter motor are connected via a one-way clutch. In the engine starting apparatus, if the engine runs in reverse rotation for some reasons, an excessive load is generated in the starter motor in some cases.

Thus, there is suggested an engine starting apparatus in which a reverse-rotation prevention clutch is mounted on an output shaft of the starter motor (e.g. refer to Japanese Patent Application Laying Open NO. 2003-83216). According to the apparatus disclosed by this application, by the action of a reverse-input cutoff clutch, a torque from the engine is not transmitted to the starter motor, regardless of the normal or reverse direction of the engine. Therefore, it is considered that even if the engine runs in the reverse rotation, the starter motor can be kept in a good condition.

DISCLOSURE OF INVENTION

However, a reverse-rotation cutoff clutch transmits a torque output from the starter motor to the engine, regardless of the rotational direction of the engine. Therefore, even if the engine runs in the reverse rotation, once the starter motor is rotated, then, the torque of the starter motor is transmitted to the engine. In such circumstances, the starter motor causes the engine that is running in the reverse rotation to run in normal rotation, and an unexpected excessive load is generated in the starter motor. Because of such an excessive load, the engine starting apparatus has a risk that not only the starter motor but also even a gear and a one-way clutch, which are power transmitting devices between the starter motor and the engine, may be damaged.

It is therefore an object of the present invention to provide an engine starting apparatus and an engine starting method, which are capable of preventing the damage of a starter motor and a power transmission mechanism, caused by the reverse rotation of an engine.

The above object of the present invention can be achieved by an engine starting apparatus provided with: a motor for transmitting a torque to an engine of a vehicle to rotate the engine; and a motor controlling device for prohibiting rotation of the motor if the engine runs in reverse rotation.

The engine starting apparatus is used for an engine of a vehicle. The "vehicle" conceptually includes an automobile, a two-wheeled vehicle, a motorized bicycle, and all that is recalled generally as a vehicle whose power source is an engine. The "engine" mainly indicates an internal combustion engine, such as a gasoline engine and a diesel engine. Further, the "engine" includes an engine partially including the combustion engine, such as a hybrid engine. For example, the engine explodes and combusts fuel in a combustion chamber in a cylinder of the internal combustion engine, and moves a piston by the power of the explosion and the combustion. In general, the engine of the automobile or the like has such a construction that the reciprocating motion of the piston is converted to rotational motion via the crankshaft or the like. Incidentally, if the engine starting apparatus of the present invention is used for such an engine, it is obvious that the type of fuel, the number or volume of the cylinders, the number of cycles, and the like are not limited.

The "motor" in the engine starting apparatus is a motor for rotating the engine of the vehicle. Moreover, the "rotation" is not the rotation of the engine to run the vehicle. The "rotation" mainly indicates the rotation of the engine to start the engine that is in a stop condition. However, it is no problem if the motor plays both roles of a motor for power output and a motor for start, in the hybrid engine. Such rotation for starting the engine can be performed except during the stop of the engine in some cases, but this case is also included in the scope of the "rotation". As the rotation described above, there is the starting rotation of the engine by a starter apparatus. As the motor in this case, there is a starter motor used for the starter apparatus. When the engine is started, for example, the starter motor is electrically rotated by the power of a battery or the like, and the rotational power or torque is transmitted to the crankshaft of the engine via a proper transmitting device, to thereby mechanically rotate the engine. During the rotation, processes of fuel intake, compression, explosion, and exhaust are started, and afterward, the engine spontaneously repeats these processes without the starter apparatus, and continues the rotation until a stop command is issued, for example, until a driver stops the engine of the vehicle. Incidentally, the "proper transmitting device" is generally a transmission mechanism constructed from a combination of the gear, the one-way clutch, and the like.

In the engine starting apparatus, "if the engine runs in the reverse condition" indicates the case where the engine rotates or turns in a different direction from the direction of the starting rotation (i.e. normal rotation) obtained by the motor in the present invention. Normally, if the engine spontaneously rotates, such reverse rotation does not occur, however, during the stop of the engine, particularly, immediately after the engine stops, the reverse rotation or reverse turn likely occurs because the engine can rotate in the both direction physically. Incidentally, such reverse rotation is typically less than a half turn if converted to the rotation angle of the crankshaft, in terms of characteristics of the engine. Even a slight reverse rotation possibly causes a problem such as the increase in a load to the motor and the damage of the transmission mechanism, as described above.

The motor controlling device in the present invention performs such control that it prohibits the rotation of the motor, in the reverse rotation condition of the engine. In this case, "prohibit" means to prohibit the rotation electrically, mechanically or in accordance with a software program. Moreover, it indicates a broad conception including all of the aspects that the reverse rotation of the engine does not cause the excessive load of the motor, such as cutting off power distribution to the motor, controlling not to operate the motor in accordance with the software program, or controlling not to rotate the motor physically, or the like.

According to the engine starting apparatus, the motor does not rotate when the engine runs in the reverse rotation. Therefore, the excessive load is not generated in the motor, which likely prevents the damage of the motor. It is also possible to prevent the damage of the transmission mechanism, such as the gear or the clutch connected to the motor and the engine. Moreover, because the possibility of the damage of each member of the transmission mechanism can be lowered as described above, it is possible to construct the transmission mechanism, such as the gear between the motor and the engine, from a light and inexpensive material, such as resin, so that a significant effect can be achieved on reduction in weight and on reduction in cost.

Incidentally, the engine starting apparatus of the present invention is preferably used for the starter apparatus which operates by turning an engine key. However, the present invention can be used for other various types of apparatus.

In one aspect of the engine starting apparatus of the present invention, the engine starting apparatus is further provided with a reverse-rotation detecting device for detecting whether or not the engine runs in the reverse rotation.

The "reverse-rotation detecting device" in this aspect may directly detect the rotational direction or turning direction of the engine, or may detect the rotation direction of something corresponding to the rotational direction of the engine, for example, the rotational direction of a tire. The rotational direction of the tire corresponds to the rotational direction of the engine if it is known for which direction a transmission is the normal direction or the reverse direction. Moreover, even if placed originally for another purpose, like an apparatus for detecting a vehicle speed, but if applicable to the detection of the reverse rotation in accordance with its structure and type, all of this kind may be included in the reverse-rotation detecting device in the present invention.

In one aspect of the engine starting apparatus having the reverse-rotation detecting device, the reverse-rotation detecting device detects whether or not the engine runs in the reverse rotation by detecting a rotational direction of a crankshaft in an arbitrary cylinder in the engine.

The crankshaft is coupled to the piston in the cylinder. The piston repeats its reciprocating motion, as described above, and the piston converts the linear reciprocating motion to rotational motion. Therefore, the rotational direction of the crankshaft corresponds to the rotational direction of the engine.

As one example of the reverse-rotation detecting device associated with this aspect, there is a reverse-rotation detecting device provided with two pulse sensors in the vicinity of teeth surfaces of a crank gear that is driven and rotated by the crankshaft. The pulse sensors generate pulses in each passage of the gear teeth. Therefore, it is possible to detect the rotational direction of the crankshaft from the timing of the pulses output from the two pulse sensors. Moreover, the use of a vehicle speed pulse allows the detection of the rotational direction of the engine.

According to this aspect, it is possible to detect the rotational direction of the engine in real time, and it is possible to preserve the motor and the surrounding parts more surely.

In another aspect of the engine starting apparatus of the present invention, the engine starting apparatus is further provided with a reverse-rotation estimating device for estimating whether or not the engine runs in the reverse rotation.

In an operation process of the engine, the incidence of the reverse rotation is extremely lower than that of the normal rotation, so in some cases, this may cause the case where the reverse rotation condition is shown only for an extremely short time. In such a case, if the reverse rotation is tried to be detected after the engine starts to run in the reverse rotation, in some cases, the reverse-rotation itself cannot be detected, or the reverse rotation is already ended at a time point of detecting the reverse rotation. However, even the rotation of the starter motor during such a short time causes the damage of the motor. "Estimate" in this aspect indicates a conception in which it is estimated whether or not the reverse rotation is generated, from a variety of mechanical, electrical, or physical conditions of the engine, experimentally, experientially, theoretically, or simulationally. By estimating the reverse rotation of the engine in advance in this manner, the rotation of the motor will be already prohibited when the engine starts to run in the reverse rotation, so that the damage of the motor is prevented.

In one aspect of the engine starting apparatus having the reverse-rotation estimating device, the reverse-rotation estimating device has a compression-condition detecting device for detecting a compression condition of a gas in an arbitrary cylinder in the engine and estimates whether or not the engine runs in the reverse rotation on the basis of the compression condition obtained by a detection result by the compression-condition detecting device.

The "gas" described here mainly means vaporized fuel. In the condition that the engine spontaneously rotates, each of the processes of intake, compression, explosion, and exhaust is repeated. In the cylinder which is in the compression process during the stop of the engine, the piston is pressed back by a reaction force of the compressed gas and the engine runs in the reverse rotation for a moment. Therefore, "the compression condition of the gas" defined in this aspect indicates two conditions, at the very least, of whether or not the piston can be pressed back by the compressed gas. Inevitablly, the "compression-condition detecting device" conceptually indicates what can judge the two conditions at the very least.

Moreover, in another aspect of the compression-condition detecting device, the compression-condition detecting device detects the compression condition of the gas on the basis of a rotation angle of a crankshaft in the arbitrary cylinder.

In the engine having such an aspect that the piston is coupled to the crankshaft, the rotation angle of the crankshaft corresponds to a process currently performed in the cylinder. Namely, if the rotation angle of the crankshaft corresponding to the compression process is known in advance, it is possible to detect the presence or absence of the cylinder which is in the compression process, from the rotation angle of the crankshaft. For example, in a normal vehicle, a crank angle is always monitored by using a crank angle sensor, to control the ignition timing of the engine. By extracting a signal from the crank angle sensor, it is possible to judge whether or not the piston is at a position where the piston is pressed back by the reaction force of the compressed gas. Moreover, with respect to the detection of the reverse rotation of the engine, the aspect of providing the two pulse sensors is explained, but if there is only a crank angle which is not accompanied by the rotational direction, the measurement can be performed by one sensor.

In another aspect of the engine starting apparatus of the present invention, the motor controlling device controls the motor to start the engine which is stopped while the vehicles stops, in accordance with a start command.

In general, such control is referred to as Economy Running (Eco-Run) control. The "stop of the vehicle" described here indicates the situation that the vehicle stops mainly during use, for example, the situation that the vehicle stops at traffic lights while driving. In the stop condition of the vehicle, the engine automatically stops under the Eco-Run control. In the engine stop condition, the engine is re-started if a predetermined action is performed. This "predetermined action" is, for example, an action of pressing an accelerator pedal by a predetermined amount. It indicates a conception including all of the aspects that the engine starting apparatus can receive the operations or actions as a command for starting the engine, namely, the above-described "start command".

Incidentally, after this predetermined action is performed, the situation that the vehicle stops and the engine is started may happen depending on circumstances, but the Eco-Run control is performed to increase the consumption efficiency of fuel, and in a range in which the effect is secured, such a situation is also included in this aspect.

Under the Eco-Run control, for example, in the case where the vehicle stops on a steep slope and the engine is stopped once, if a clutch pedal is engaged more quickly than the predetermined action for re-starting the engine, the vehicle moves backward and thus the engine may run in the reverse rotation. Namely, under the Eco-Run control, there are more chances that the reverse rotation of the engine occurs than a general vehicle, which increases the risk of the damage of the starter motor. According to this aspect, however, such a risk can be reduced significantly, so that it is efficient.

Moreover, under the Eco-Run control, the engine is repeatedly stopped and started frequently, so that if a battery of a charge type is used as the power of the engine starting apparatus, the frequency of use of the battery increases as well. In such a condition, there is a possibility that the battery becomes in an excessive discharge condition and the stopped engine cannot be started. In preparation for this case, under the Eco-Run control, such control is performed that the residual quantity of electricity accumulation of the battery is monitored, and if it reaches to a certain level, the start command is issued to start the engine, regardless of a departure command for the vehicle (for example, while the vehicle is stopped), to thereby maintain the amount of the electricity accumulation at a sufficient level. A signal output on the basis of the residual quantity of the electricity accumulation of the battery, as described above, is also included in the above-described "predetermined action" in a broad meaning.

The above object of the present invention can be also achieved by an engine starting method used for an engine starting apparatus provided with: a motor for transmitting a torque to an engine of a vehicle to rotate the engine; and a motor controlling device for prohibiting rotation of the motor if the engine runs in reverse rotation, the motor controlling device controlling the motor to start the engine which is stopped while the vehicles stops in accordance with a start command, the engine starting method provided with: a first process of receiving the start command; a second process of judging whether or not the engine runs in the reverse rotation if the start command is received; and a third process of controlling the motor to start the engine if it is judged in the second process that the engine does not run in the reverse rotation.

These functions and other advantages of the present invention will be apparent from the following description of embodiments.

BEST MODE FOR CARRYING OUT THE INVENTION

The best mode for carrying out the present invention will be hereinafter explained in order, with reference to the drawings.

Figure 1:
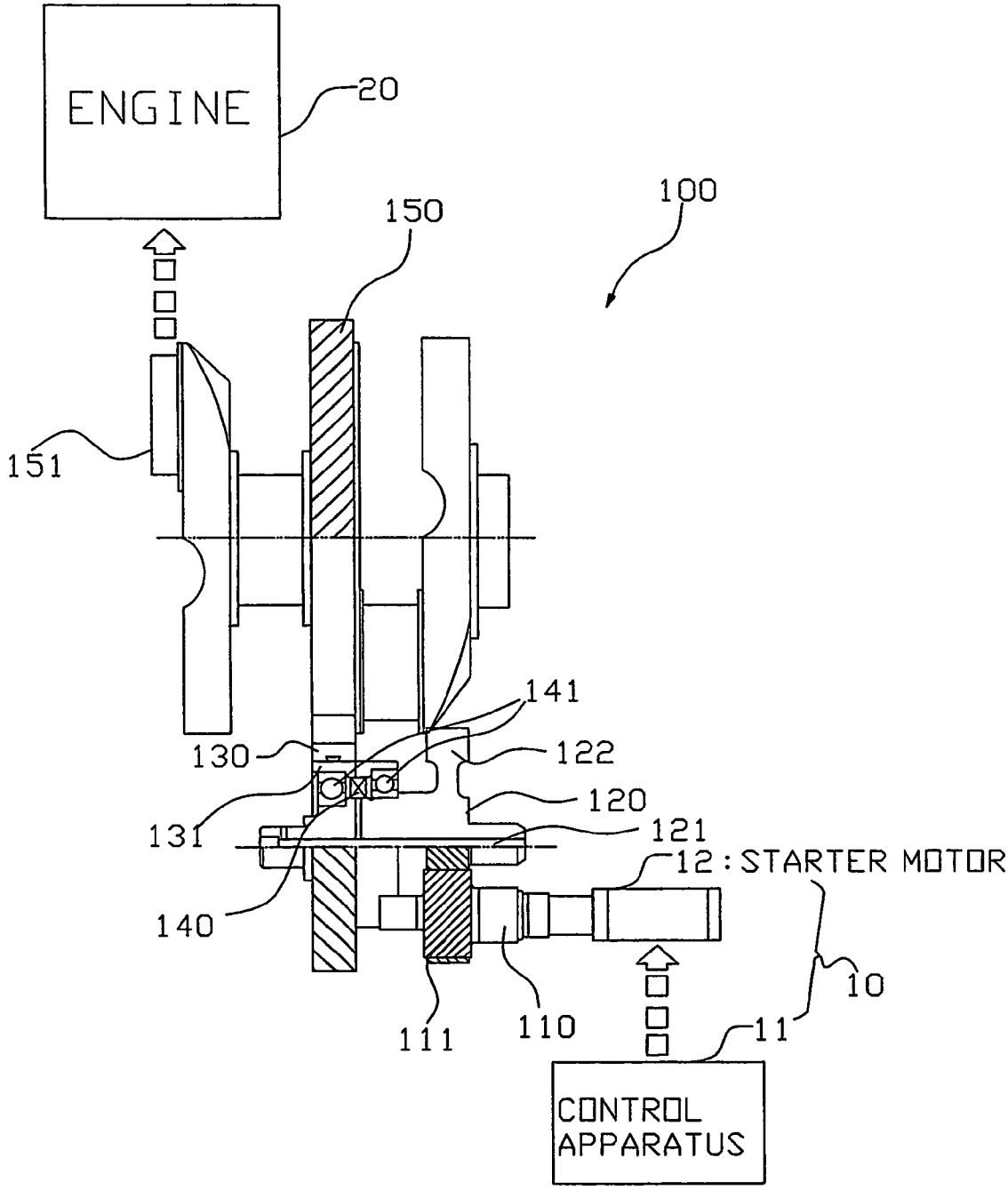
FIG. 1 is a half sectional view conceptually showing a power output apparatus in an embodiment of the present invention.

At first, the structure and operation of a power output apparatus, which includes an engine starting apparatus, a transmission mechanism, and an engine, in an embodiment of the present invention will be explained with reference to FIG. 1. FIG. 1 conceptually shows the power output apparatus.

In FIG. 1, the power output apparatus in the embodiment includes: an engine starting apparatus 10; a transmission mechanism 100; and an engine 20.

The engine starting apparatus 10 is an apparatus for rotating to start the engine 20, and is provided with: a starter motor 12 and a control apparatus 11 for controlling the start operation of the starter motor 12. The detailed structure and operation of the engine starting apparatus 10 will be described later (refer to FIG. 2 and FIG. 3).

The engine 20 is a general gasoline engine. For convenience of understanding, FIG. 1 shows only one engine 20, but a plurality of engines 20 are connected to a crankshaft 151. It is constructed such that, during combustion, pistons, connection rods and other members of the engine 20 move in the normal direction, with the rotation of the crankshaft 151.

The transmission mechanism 100 is placed between the engine starting apparatus 10 and the engine 20, and is constructed to transmit a torque output from the engine starting apparatus 10 to the engine 20 in order to start the engine 20. The transmission mechanism 100 substantially has the following structure.

A starter gear shaft 110 is a rotation shaft for inputting the torque from the starter motor 12 to the transmission mechanism 100. A starter gear 111 is fixed around the starter gear shaft 110 and can rotate with the starter gear shaft 110 in one body in the same direction.

A sub-driven gear 120 is engaged with the starter gear 111. The sub-driven gear 120 is engaged with a driven gear 122 which is fixed around a driven gear shaft 121. By the driven gear 122, the driven gear shaft 121 rotates with the driven gear 122 in the same direction.

An intermediate gear 130 is fixed around an intermediate gear shaft 131. Between the intermediate gear 130 and the driven gear 122, there is a one-way clutch 140 placed, which is supported by a bearing 141 and other supporting members.

A crank gear 150 is engaged with the intermediate gear 130. The crank gear 150 is fixed around a crankshaft 151. The crankshaft 151 rotates in accordance with the rotation of the crank gear 150. The crankshaft 151 is connected to the pistons of the engine 20 via the connection rods and other members which are not illustrated. Under the construction described above, when the starter motor 12 of the engine starting apparatus 10 rotates in order to start the engine 20, the rotation is converted to the rotations of the starter gear 111, the driven gear 122, the one-way clutch 144140 the intermediate gear 130, and the crank gear 150, and transmitted to the crank shaft 151. By the rotation of the crank shaft 151, the engine 20 starts. The direction of the rotation of the engine 20 at this time is the normal direction of the engine 20.

Figure 2:
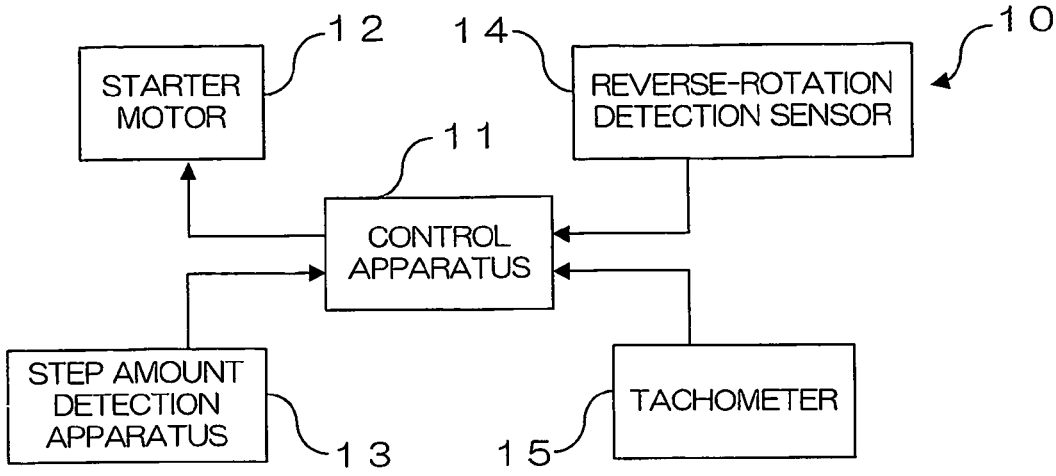
FIG. 2 is a block diagram of an engine starting apparatus in the embodiment of the present invention.

Next, the structure of the engine starting apparatus 10 will be explained with reference to FIG. 2. FIG. 2 is a block diagram showing the engine starting apparatus 10.

In FIG. 2, the control apparatus 11 is an apparatus for controlling the operation of the engine starting apparatus 10. The starter motor 12 is a motor for starting the engine 20 and is connected to a not-illustrated power source and electric wirings. The starter motor 12 rotates in a predetermined direction by the control of the control apparatus 11. This torque is transmitted to the starter gear shaft 110 (FIG. 1).

A step-amount detection apparatus 13 is connected to a not-illustrated accelerator pedal and has a sensor function of detecting a step amount of the accelerator pedal. If the accelerator pedal is pressed by a predetermined amount or more, a start command pulse is output from the step-amount detection apparatus 13 to the control apparatus 11. The control apparatus 11 receives the start command pulse as a start command for the engine 20.

There are various techniques to detect the reverse-rotation of the engine. In the embodiment, the technique of detecting the rotational direction of the crankshaft is selected. Namely, the reverse-rotation detection sensor 14 has two rotation-pulse sensors, which are not illustrated, for detecting the rotational direction of the crankshaft 151. If detecting the reverse rotation of the engine 20, the reverse-rotation detection sensor 14 outputs a reverse-rotation detection pulse to the control apparatus 11. Moreover, a tachometer 15 is an apparatus for measuring the number of rotations or rotational speed of the engine 20.

Figure 3:
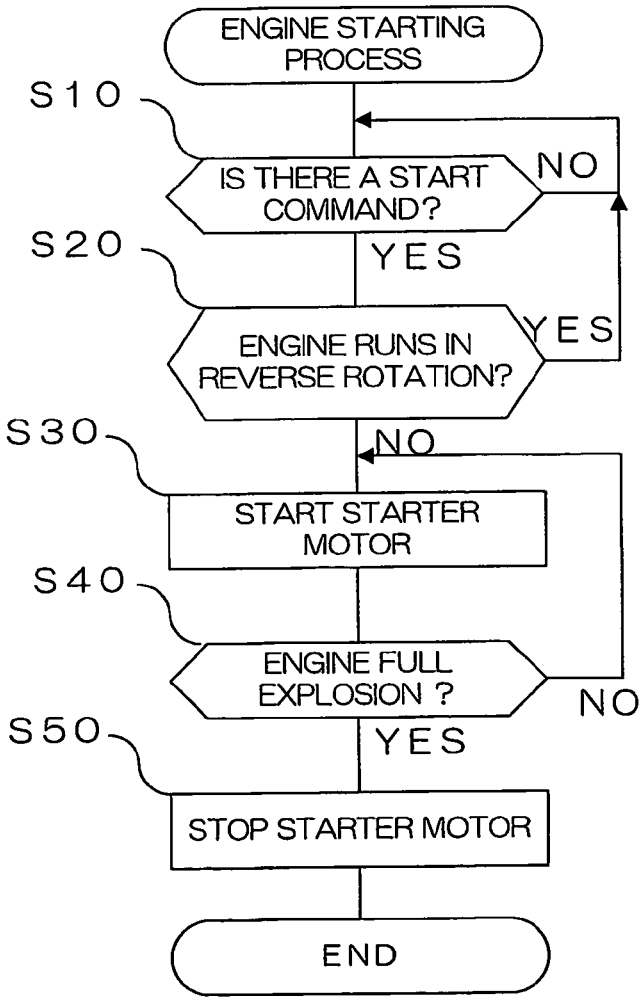
FIG. 3 is a flowchart explaining the operation of the engine starting apparatus.

Next, the operation of the engine starting apparatus 10 will be explained with reference to FIG. 3. FIG. 3 shows an engine starting process performed by the control apparatus 11. Incidentally, the engine starting apparatus 10 in the embodiment is used for a vehicle under the Eco-Run control. FIG. 3 explains the engine starting process of starting the engine from a stop condition by the Eco-Run control.

In FIG. 3, at first, the control apparatus 11 judges the presence or absence of the engine start command (step S10). The embodiment is constructed such that the engine 20 is re-started by pressing the accelerator pedal by the predetermined amount or more. The control apparatus 11 detects the presence or absence of the start command pulse as being the output of the step-amount detection apparatus 13, at constant clock timing. If the start command pulse is not detected (the step S10: NO), the control apparatus 11 repeats the step 10 until the start command pulse is detected. If the start command pulse is detected (the step S10: YES), the control apparatus 11 subsequently judges whether or not the engine 20 runs in the reverse rotation (step S20).

The control apparatus 11 detects the presence or absence of the reverse-rotation detection pulse as being the output of the reverse-rotation detection sensor 14. If the reverse-rotation detection pulse is detected (the step S20: YES), the control apparatus 11 regards that the engine 20 is rotating in the reverse direction, and returns the engine starting process to the step S10 again. Then, the step 10 and the step 20 are repeated until the reverse rotation ends. If the reverse-rotation detection pulse is not detected (the step S20: NO), the control apparatus 11 regards that the engine 20 is not rotating in the reverse direction, and starts power distribution to the starter motor 12, to thereby rotate the starter motor 12 (step S30).

The control apparatus 11 is connected to not-illustrated engine control apparatuses for performing the supply of fuel to the engine 20, ignition timing control and other processes. If the starter motor 12 is rotated by the step S30, the torque of the starter motor 12 is converted to the rotation of the crankshaft 151, and further converted to the reciprocating motion of the pistons. This engine control apparatus performs the supply of fuel, ignition and other necessary processes, at proper timings, during the starting rotation obtained by the engine starting apparatus 10, to thereby start the spontaneous rotation of the engine 20.

Then, the control apparatus 11 confirms the number of rotations of the engine 20 by referring to the tachometer 15, and performs a full explosion judgment (step S40). The full explosion judgment is to judge whether or not the rotation of the engine 20 is stabilized. In the embodiment, it is judged by whether or not the number of rotations of the engine 20 is more than or equal to 400 revolutions per minute (rpm) and by whether or not it does not lower than the number of the rotations of the engine during a constant period. It is obvious that this judgment standard is not limited to this aspect. If it is judged that the number of rotations of the engine 20 is not stabilized (the step S40: NO), the control apparatus 11 returns the engine starting process to the step S30, and continues the power distribution to the starter motor 12, to thereby keep the starter motor 12 rotating. If it is judged that the rotation of the engine 20 is stabilized (the step S40: YES), the control apparatus 11 cuts off the power distribution to the starter motor 12 to stop the starter motor 12 (step S50), and ends the engine starting process in the embodiment.

In the embodiment, the method of detecting the reverse-rotation of the engine is not limited to the exemplified aspect in the above-described step S20. For example, it is possible to detect the reverse-rotation of the engine in the following manner.

For example, two sensors may be placed in the vicinity of the outer circumference of a rotation element, such as flywheel, which rotates with the engine. The sensors monitor the passage of gear teeth, which are formed in the outer circumference of the rotation element and arranged at regular intervals in the circumferential direction. Moreover, the two sensors are placed such that the waveforms of their pulse signals which are generated in each passage of the gear teeth mutually have a phase difference. Here, the pulse output from each sensor is input to an operation circuit, and a deviation signal obtained by subtracting one signal from the other is output from the operation circuit. If the deviation signal is filtered by a filter device including a differential element, the output signal includes an excessive pulse waveform caused by transient features. A process pulse signal, which is obtained by inputting the output signal to a comparison circuit, varies greatly depending on the rotational direction of the engine because of the excessive pulse, by which it is possible to detect the rotational direction of the engine.

Moreover, the rotational direction of the engine can be also detected by using a crankshaft angle sensor and a camshaft angle sensor. For example, two different crankshaft positions, which are detected by the crankshaft angle sensor for monitoring a crankshaft sensor wheel, are assigned to a predetermined camshaft position, which is detected by the camshaft angle sensor for monitoring a camshaft sensor wheel. The two crankshaft positions correspond to the normal rotation and reverse rotation of the engine, respectively. By knowing which crankshaft position is detected, it is possible to judge the rotational direction of the engine.

Moreover, the following aspect can be also used. Namely, in the outer circumference of a circular member, which is driven to rotate in synchronization with the rotation of the engine, two indicators are placed, with each indicator having a different angular width. A sensor is placed in the vicinity of the outer circumference of the circular member. This sensor generates such a pulse that has a time width corresponding to the angular width of each indicator. In such a construction, a ratio (a)/(b) varies depending on the rotational direction of the engine, wherein (a) is a time length from the end of a first pulse, whose time width is short, to the end of a second pulse, whose time width is long, and (b) is a time length from the end of the first pulse to the start of a next first pulse. Therefore, by comparing these, it is possible to judge the normal or reverse direction of the rotational direction of the engine.

Incidentally, the embodiment is constructed such that the start command for starting the engine 20 is output to the control apparatus 11 by pressing the accelerator pedal while a vehicle stops. As described above, however, such a case is also conceivable that the command for starting the engine 20 is output depending on the residual quantity of a battery as being a power source for the starter motor 12, independently of the step of the accelerator pedal, to thereby start the starter motor 12.

The present invention is not limited to the above-described embodiments, and changes may be made, if desired, without departing from the scope or spirit of the invention which can be read from the claims and the entire specification. An engine starting apparatus and an engine starting method that accompany such changes are also intended to be within the technical scope of the present invention.

INDUSTRIAL APPLICABILITY

An engine starting apparatus and an engine starting method that are associated with the present invention can be applied to an internal combustion engine in a general vehicle, such as an automobile and a two-wheeled vehicle, whose power source is the engine.

The invention claimed is:

1. An engine starting apparatus comprising:

a motor for transmitting a torque to an engine of a vehicle to rotate the engine; and a motor controlling device for prohibiting rotation of said motor if the engine runs in reverse rotation.

2. The engine starting apparatus according to claim 1, further comprising a reverse-rotation detecting device for detecting whether or not the engine runs in the reverse rotation.

3. The engine starting apparatus according to claim 2, wherein the reverse-rotation detecting device detects whether or not the engine runs in the reverse rotation by detecting a rotational direction of a crankshaft in an arbitrary cylinder in the engine.

4. The engine starting apparatus according to claim 1, further comprising a reverse-rotation estimating device for estimating whether or not the engine runs in the reverse rotation.

5. The engine starting apparatus according to claim 4, wherein the reverse-rotation estimating device has a compression-condition detecting device for detecting a compression condition of a gas in an arbitrary cylinder in the engine and estimates whether or not the engine runs in the reverse rotation on the basis of the compression condition obtained by a detection result by the compression-condition detecting device.

6. The engine starting apparatus according to claim 5, wherein the compression-condition detecting device detects the compression condition of the gas on the basis of a rotation angle of a crankshaft in the arbitrary cylinder.

7. The engine starting apparatus according to claim 1, wherein said motor controlling device controls, in accordance with a start command, said motor to start the engine which is stopped while the vehicles stops.

8. The engine starting apparatus according to claim 1, further comprising a transmission mechanism for transmitting a torque from the motor to the engine, wherein the transmission mechanism comprises: a starter gear member including a starter gear and a starter gear shaft; a driven gear member including a driven gear and a driven gear shaft; an intermediate gear member including an intermediate gear and an intermediate gear shaft; a crank gear member including a crank gear and a crank gear shaft; and a one-way clutch, the starter gear member transmits the torque from the starter motor to the driven gear member, the driven gear member transmits the torque from the starter motor to the intermediate gear member, the intermediate gear member transmits the torque from the driven gear member to the crank gear member, the crank gear member transmits the torque from the intermediate gear member to the engine, and the one-way clutch is placed between the driven gear member and the intermediate gear member.

9. An engine starting method used for an engine starting apparatus comprising: a motor for transmitting a torque to an engine of a vehicle to rotate the engine; and a motor controlling device for prohibiting rotation of said motor if the engine runs in reverse rotation, said motor controlling device controlling, in accordance with a start command, said motor to start the engine which is stopped while the vehicles stops, said engine starting method comprising:

a first process of receiving the start command;

a second process of judging whether or not the engine runs in the reverse rotation if the start command is received; and a third process of controlling said motor to start the engine if it is judged in said second process that the engine does not run in the reverse rotation.

* * * * *